US005584244A

United States Patent [19]

Klingler et al.

[11] Patent Number: 5,584,244

[45] Date of Patent: Dec. 17, 1996

[54] METHOD FOR STARTING THE PRODUCTION RUN ON A SHEET-PROCESSING PRINTING MACHINE

[75] Inventors: Horst Klingler, Muhlheim; Joachim Muller, Pullach, both of Germany

[73] Assignee: MAN Roland Druckmaschinen AG, Germany

[21] Appl. No.: 399,058

[22] Filed: Mar. 8, 1995

[30] Foreign Application Priority Data

Mar. 8, 1994 [DE] Germany ..... 44 07 631.2

[51] Int. Cl.[6] ..... B41F 13/24

[52] U.S. Cl. ..... 101/484; 101/144; 101/232

[58] Field of Search ..... 101/141, 142, 101/144, 145, 216, 217, 218, 232, 483, 484, 485; 271/10, 11, 8.1, 103, 270

[56] References Cited

U.S. PATENT DOCUMENTS

| | | | |
|---|---|---|---|
| 3,056,346 | 10/1962 | Gammeter et al. | 101/144 |
| 3,949,864 | 4/1976 | Montsant | 101/232 |
| 3,960,079 | 6/1976 | Capetti | 101/232 |
| 4,038,921 | 8/1977 | Harrison et al. | 101/232 |
| 4,262,590 | 4/1981 | Bruckner | 101/144 |
| 5,142,981 | 9/1992 | Dettinger et al. | 101/248 |
| 5,213,036 | 5/1993 | Tokuno et al. | 101/232 |
| 5,272,975 | 12/1993 | Dettinger et al. | 101/218 |

FOREIGN PATENT DOCUMENTS

| | | |
|---|---|---|
| 2637071A1 | 2/1977 | Germany . |
| 2701180A1 | 9/1977 | Germany . |
| 2921955A1 | 12/1980 | Germany . |
| 2930270C2 | 4/1986 | Germany . |
| 4013075C1 | 6/1991 | Germany . |
| 4206626A1 | 9/1993 | Germany . |

*Primary Examiner*—Christopher A. Bennett
*Attorney, Agent, or Firm*—Leydig, Voit & Mayer, Ltd.

[57] ABSTRACT

A method for starting/restarting the production run on a sheet-processing printing machine in which the sheets to be printed are fed from a stack to the printing machine by a feeder assembly couplable to the printing machine and including separately actuable members causing removal of sheets from the stack, the method comprising the steps of: rotating the printing machine at a basic rotational speed; cutting in the feeder assembly; running-up the coupled printing machine and feeder assembly to a higher rotational speed, and cutting in the members causing removal of sheets from the stack to cause sheets to be conveyed into the printing machine.

3 Claims, 2 Drawing Sheets

METHOD FOR STARTING THE PRODUCTION RUN ON A SHEET-PROCESSING PRINTING MACHINE

FIELD OF THE INVENTION

The invention relates generally to methods for controlling printing machines, and more particularly to a method for starting/restarting the production run on a sheet-processing printing machine.

BACKGROUND OF THE INVENTION

On sheet-fed offset printing machines of the type in widespread use, the sheets to be printed are processed through several steps prior to actual printing. These preparatory steps are carried out in a feeder assembly, which includes members causing the removal of sheets from the stack, members for conveying the sheets over a feeder table to a sheet feed, and the sheet feed itself. The feeder assembly illustratively operates as follows. First, the sheets to be printed are extracted from the top side of a sheet stack in the feed assembly by means of the members causing the removal of the sheets from the stack, illustratively in the form of separating and dragging suckers. Next, the sheets are conveyed over a feeder table to the sheet feed. There, they are aligned and, when a correct sheet feed has been detected, grasped by a pre-gripper or the like and printed in the individual printing units. As is known from DE 2,930,270 C2, the feeder assembly is coupled to the drive of the printing unit via a magnetic coupling and the members causing the removal of sheets from the stack are actuable separately from the conveying means and the sheet feed. FIG. 1 is from DE 2,930,270 C2, which is expressly incorporated herein by reference, and which shows a magnetic coupling 18 between a printing unit and a feeder assembly, and a separately actuable member 8 causing the removal of the sheets from the stack. The switching of the blowing and suction air for the members causing the removal of the sheets from the stack (the separating and dragging suckers) takes place via switchable solenoid valves.

In conventional sheet-fed offset printing machines, the starting or restarting of a production run proceeds in the following manner. First, with the feeder assembly uncoupled, the printing machine is run up to a so-called basic rotational speed. This basic rotational speed is illustratively 3,000 sheets per hour. This basic rotational speed is chosen so that a cut-in of the feeder assembly via the magnetic coupling is still possible. To insure that the feeder assembly runs in phase with the printing machine, the magnetic coupling has positively cooperating coupling parts. However, this also means that a cut-in of the feeder assembly at a higher rotational speed is not possible.

After the feeder assembly has been cut in at the basic rotational speed of the printing machine, a cut-in of the separately actuable members causing the removal of the sheets from the stack likewise takes place. When a first sheet has been detected as correctly aligned at the feed (front-lay query), the grasping of the sheet by the pre-gripper occurs. In the individual printing units, the "print on" command is then given automatically, so that the rubber-blanket cylinders are thrown onto the corresponding plate cylinder and then, for the subsequent printing of the first sheet, onto the respective impression cylinder.

Only after the above-described entry of the first sheet does a run-up of the printing speed to the intended production or production-run speed take place. However, the sheets printed during the run-up of the printing speed are usually discards, since an ink/dampening medium equilibrium must first be established during the run-up operation. During the run-up operation, inking differences arise as a result of drive torsion.

DE 4,206,626 A1 discloses a method for reducing mackling during the starting of a sheet-fed printing machine. According to that method, in which, when a first sheet arrives in the respective printing unit, the rubber-blanket cylinders and the impression cylinders, largely non-reactively uncoupled from the preceding printing units, are thrown onto one another for the production run. Although the jolts reacting on the drive as a result of the throw-on of the printing-unit cylinders for printing are minimized in this method, the discards are still not appreciably reduced. This is again due to the inking differences caused by the run-up operation, in conjunction with drive torsion.

DE 4,013,075 C1 discloses a device for the print thrown-on/thrown-off of a rubber-blanket cylinder in the printing unit of a sheet-fed offset printing machine, which makes it possible to trigger the "print on" command non-reactively even at high rotational speeds of the machine.

SUMMARY OF THE INVENTION

The primary object of the present invention is to provide a method for coordinating the cutting in of the feeder assembly and the separately actuable members causing the removal of the sheets from the stack in such a way that the discards occurring during the run-up of the printing speed can be avoided.

According to the invention, provision is made for cutting in the feeder assembly at the basic speed of the printing machine, whereas the members causing the removal of the sheets from the stack remain cut out. After the feeder assembly has been cut in, the printing machine is run up to a higher rotational speed, illustratively the intended production speed. When this higher rotational speed is reached, a cut-in of the members causing the removal of the sheets from the stack takes place. The sheets then run over the feeder table to the sheet feed and a first sheet correctly detected at the sheet feed can then enter the machine. The logical triggering of the "print on" command then takes place in the individual printing units according to the sheet run.

The invention ensures that a first sheet entering the machine for printing is printed at the higher rotational speed. The build-up operation for inking and dampening commences without any faults, since printing commences at the intended speed.

Furthermore, no discards are printed on account of drive torsion and mackling or register deviations caused thereby.

Since, as before, the feeder assembly is cut in via the magnetic coupling at the basic rotational speed of the printing machine and only thereafter does the run-up of the machine take place, no additional load acts on the coupling parts. The cut-in of the members causing the removal of the sheets from the stack (for example, separating and dragging suckers, blowing air, etc.) presents no problem at a high machine speed and therefore also feeder speed.

BRIEF DESCRIPTION OF THE DRAWINGS

An explanation of two advantageous exemplary embodiments of the invention is given with references to the three Figures, wherein.

DETAILED DESCRIPTION OF THE PREFERRED EMBODIMENTS

While the invention will be described and disclosed in connection with certain preferred embodiments and procedures, it is not intended to limit the invention the those specific embodiments. Rather, it is intended to cover all such alternative embodiments and modifications as fall within the spirit and scope of the invention as defined by the appended claims.

All of the references cited herein are hereby incorporated in their entirety by reference.

Figure 1:
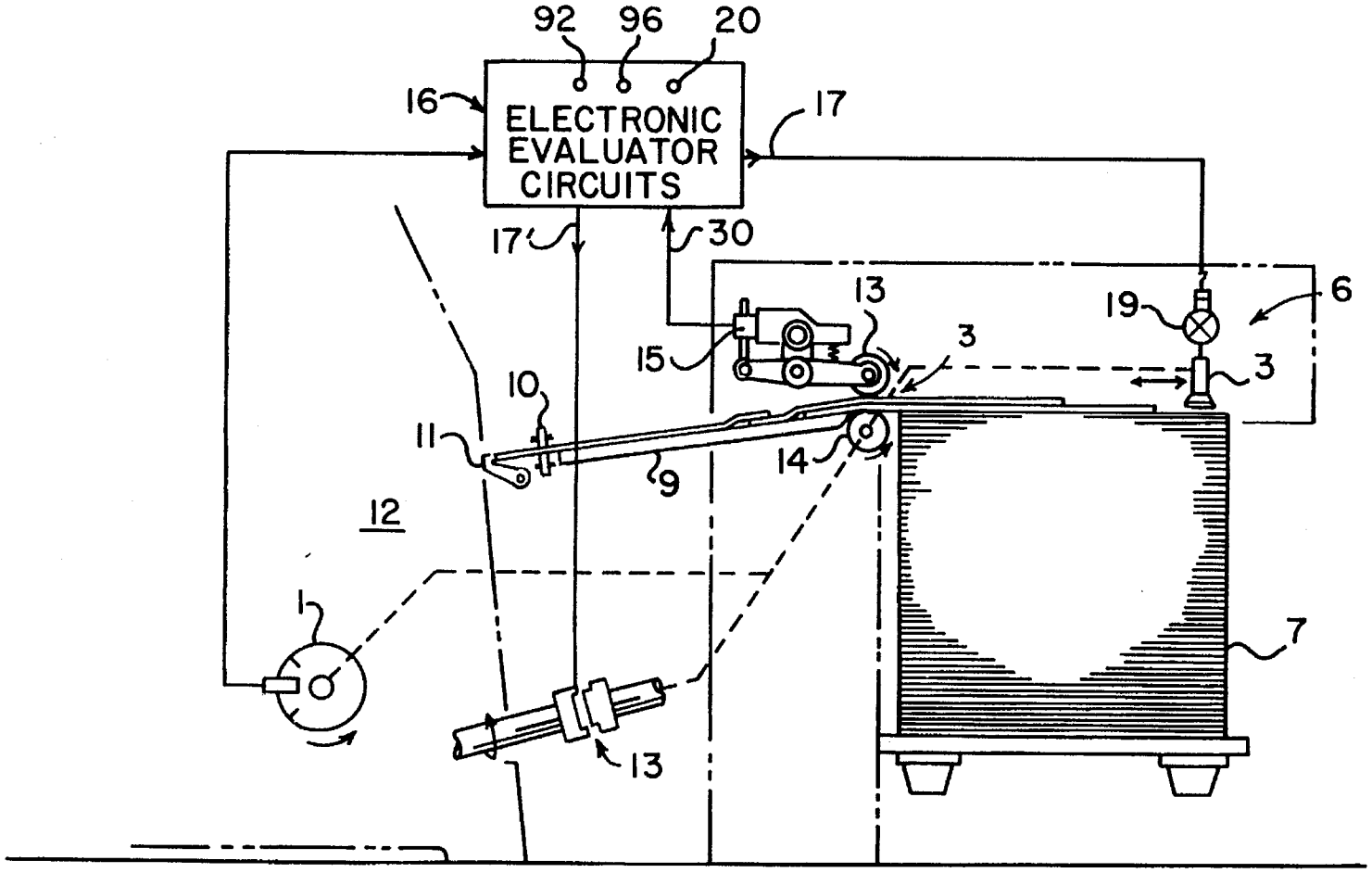
FIG. 1 PRIOR ART
FIG. 1 is a prior art drawing showing a representative feeder assembly and printing unit.
Figure 2:
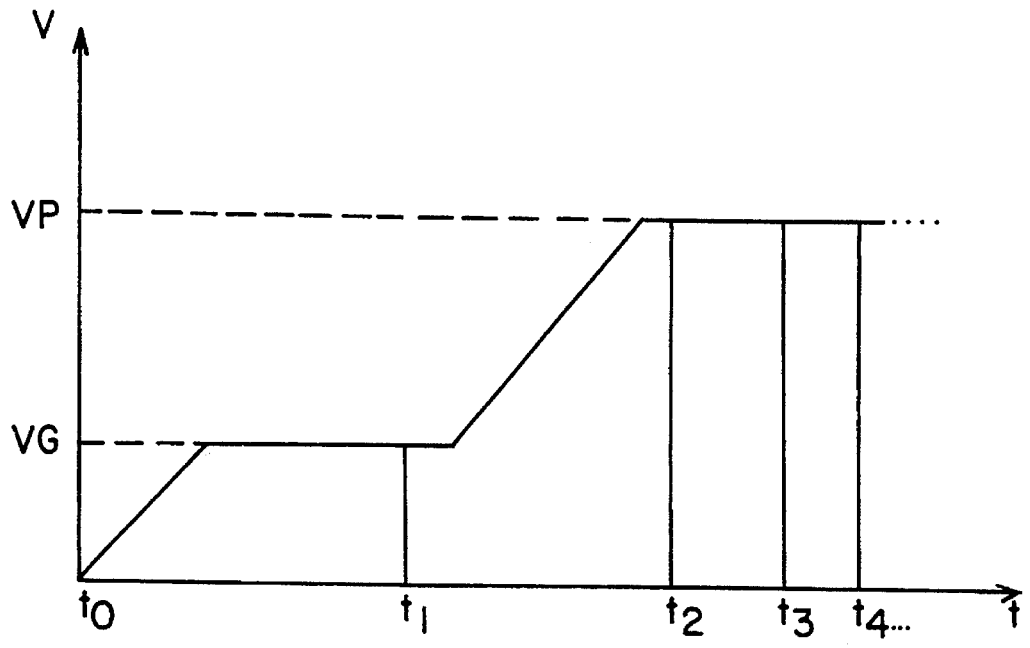
FIG. 2 is a graph, having a time axis as the abscissa and a rotational velocity axis as the ordinate, showing the trend in time of the run-up of the printing machine and the corresponding switching operations.
Figure 3:
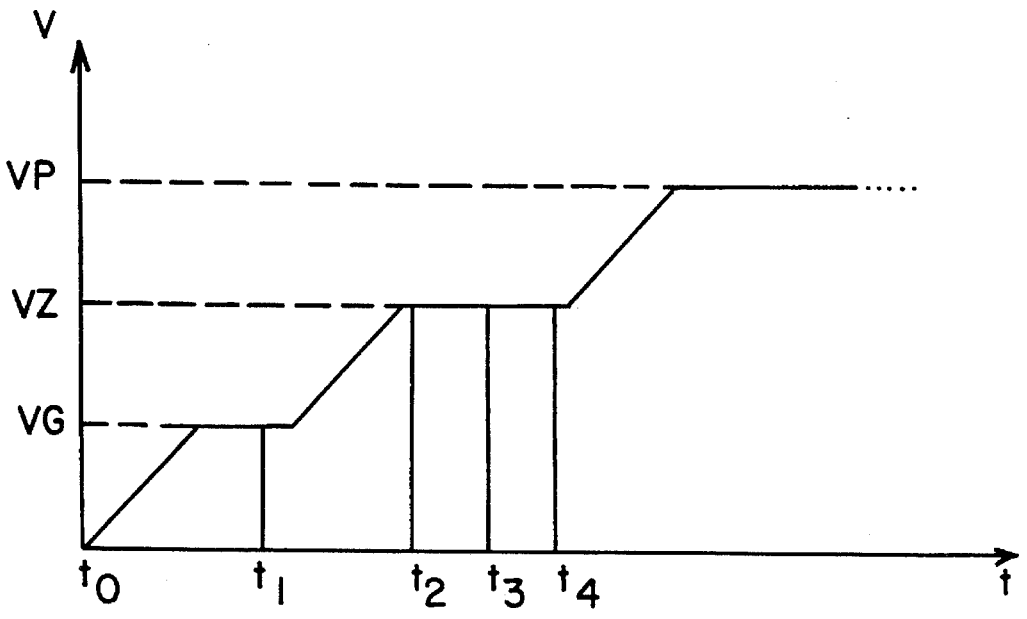
FIG. 3 is a similar graph to FIG. 2 showing an alternative method according to the invention.

Turning now to the drawings,. FIGS. 2 and 3 graphically illustrate two methods for carrying out the inventive method. Illustratively, such method will be performed on a sheet-fed press as in FIG. 1 including a magnetic coupling 18 between a feeder assembly and a printing unit, and including separately actuable members, such as suckers 8, for causing the removal of sheets from the stack. In both FIGS. 2 and 3, the time axis (abscissa) is denoted by T and the printing speed/rotational speed (ordinate) by V. According to the first embodiment of the method, as shown in FIG. 2, at a time point t0, the main drive of the printing unit is switched on, so that, with the feeder assembly uncoupled, the speed V of the printing machine is run up from V=O according to a predetermined time ramp to the basic rotational speed VG. The feeder assembly is uncoupled, and suction and blowing air for the corresponding members causing the removal of sheets from the stack is likewise cut out. The cylinders in the individual printing units and the applicator roller of the inking and dampening units are in the "print off" state.

At a time point t1, the feeder assembly is cut in at the basic rotational speed VG by a corresponding switching of the magnetic coupling between the feeder and the printing unit. The members causing the removal of the sheets from the stack remain, as before, cut out.

After the feeder has been coupled a the time point t1, the speed of the printing machine is run up from the basic rotational speed VG according to a predetermined time ramp to a higher rotational speed which, according to this embodiment, is the production speed VP. This run-up is achieved by corresponding activation of the main drive. After a specific time span, the printing machine and coupled feed assembly reach the intended production speed VP. According to the invention, provision can be made, during this run-up phase, for already throwing the dampening and ink applicator rollers onto the associated plate cylinder in the individual printing units for pre-inking and pre-dampening and, furthermore, also, in order to pre-ink the rubber-blanket cylinder, for throwing the latter onto the respective plate cylinder.

After the printing machine has reached its production speed VP, at a time point t2 the members causing the removal of the sheets from the stack, such as separating and dragging suckers, are cut in by activating one or more solenoid valves. A first sheet is then conveyed over the feeder table to the feed and, at the time point t3, is detected as being present and correct at the sheet feed (front-lay check), whereupon it is grasped by a pre-gripper and conveyed through the printing machine via sheet-guiding cylinders. At a time point t4, the throw-on of the rubber-blanket cylinder in the first printing unit then takes place on the impression cylinder, so that the first sheet is printed in the first printing unit. The logical cut-in of the rubber-blanket cylinders onto the impression cylinders in the remaining printing units takes place in a similar way and likewise automatically by means of a control known per se. According to the method, then, the first sheet entering the printing unit is printed at the production speed. This provides for a reduction in discards since the build-up operation for inking and dampening was carried out during the run-up of the printer unit and coupled feeder assembly from the basic rotational speed.

FIG. 3 shows a second preferred embodiment of the method according to the invention. In a similar way to the explanation given above, the drive of the printing machine is activated, with the feeder assembly uncoupled, at a time point t0 in such a way that the printing machine runs up to the basic rotational speed VG. At a time point t1, the coupling of the feeder assembly takes place, with the members causing the removal of the sheets from the stack, such as separating and dragging suckers, remaining cut-out.

The printing machine and coupled feeder assembly are then run up from the basic rotational speed VG according to a predetermined time ramp to a higher rotational speed, which in this case is an intermediate rotational speed VZ. This intermediate rotational speed VZ is, for example, a specific amount below the production speed VP finally intended, and higher than that rotational speed at which the feeder assembly can still be cut in. After the printing machine has reached this intermediate rotational speed VZ, at a time point t2, the members causing removal of sheets from the stack, illustratively in the form of separating and dragging suckers, are cut in, so that, at a time point t3, a first sheet correctly detected at the feed can enter the machine. Here too, provision can be made for already pre-dampening and pre-inking the plate and rubber-blanket cylinders in the individual printing units.

After the sheet entry into the printing machine has commenced after the time point t3, the logical cut-in of the plate cylinders onto the corresponding impression cylinders then takes place in the individual printing units, for example likewise at the intermediate rotational speed VZ. FIG. 2 indicates merely the corresponding time point t4 for the first printing unit. The first sheet in the printing machine is thus printed at the intermediate rotational speed VZ. Provision can then be made, after printing has been cut in in all of the printing units, from the intermediate rotational speed VZ to the production speed VP finally intended.

The two above-described alternative embodiments of the method according to the invention are initiated preferably by means of an automatic control, for example via a machine control station, by program control. Provision can thus be made, in general, for both the conventional run-up and the starting method described according to the invention to be capable of being initiated selectively by means of the automatic starting control.

We claim:

1. A method for starting a production run on a sheet—processing printing machine, wherein sheets to be printed are fed from a stack to a printing unit through a feeder assembly including a sheet feed and separately actuable members causing removal of the sheets from the stack, the feeder assembly being selectively coupled to the printing unit through a switchable coupling, the method comprising the steps of:

rotating the printing unit at a low basic rotational speed;

cutting-in the feeder assembly at the low basic rotational speed by actuating the switchable coupling;

running up the coupled printing unit and feeder assembly to a higher predetermined rotational speed;

cutting-in the members causing removal of sheets from the stack to cause sheets to be conveyed into the printing unit for printing.

2. Method according to claim 1, wherein the higher predetermined rotational speed is the production speed intended for the production run.

3. Method according to claim 1, wherein the higher predetermined rotational speed is an intermediate rotational speed between the basic rotational speed and the production speed.

* * * * *